US008234823B2

(12) United States Patent
McClure et al.

(10) Patent No.: US 8,234,823 B2
(45) Date of Patent: Aug. 7, 2012

(54) TELESCOPING MAST

(76) Inventors: Clifton D. McClure, Madison, AL (US); Jonathan M. Lance, Sr., Harvest, AL (US)

( * ) Notice: Subject to any disclaimer, the term of this patent is extended or adjusted under 35 U.S.C. 154(b) by 499 days.

(21) Appl. No.: 12/499,596

(22) Filed: Jul. 8, 2009

(65) Prior Publication Data

US 2010/0005734 A1 Jan. 14, 2010

Related U.S. Application Data

(60) Provisional application No. 61/079,329, filed on Jul. 9, 2008.

(51) Int. Cl.
*B66C 23/06* (2006.01)

(52) U.S. Cl. ..... 52/111; 52/114; 52/115; 52/117; 52/118

(58) Field of Classification Search ..... 52/111, 52/114, 115, 117, 118, 121, 632, 831, 848
See application file for complete search history.

(56) References Cited

U.S. PATENT DOCUMENTS

| | | | | | |
|---|---|---|---|---|---|
| 178,562 | A | | 6/1876 | Renwick et al. | |
| 725,964 | A | | 4/1903 | Hogeland | |
| 1,057,414 | A | * | 4/1913 | Schlayer | 182/141 |
| 1,286,807 | A | | 12/1918 | Seymour | |
| 1,342,828 | A | * | 6/1920 | Seymour | 52/111 |
| 2,942,700 | A | | 6/1960 | Parmenter et al. | |
| 2,987,148 | A | * | 6/1961 | Millard | 52/111 |
| 3,517,771 | A | | 6/1970 | Mahringer et al. | |
| 3,556,250 | A | | 1/1971 | Miele | |
| 3,752,261 | A | | 8/1973 | Bushnell, Jr. | |
| 3,802,136 | A | | 4/1974 | Eiler et al. | |
| 4,077,616 | A | | 3/1978 | Smejkal et al. | |
| 4,085,796 | A | * | 4/1978 | Council | 166/77.53 |
| 4,231,200 | A | * | 11/1980 | Henderson | 52/111 |
| 4,238,911 | A | | 12/1980 | Mazur | |
| 4,295,317 | A | * | 10/1981 | VanTielen | 52/637 |
| 4,468,904 | A | | 9/1984 | O'Malley | |
| 4,864,784 | A | * | 9/1989 | Binge et al. | 52/108 |
| 5,205,101 | A | * | 4/1993 | Swan et al. | 52/650.1 |
| 6,065,267 | A | * | 5/2000 | Fisher | 52/692 |
| 6,082,068 | A | * | 7/2000 | Fisher | 52/633 |
| 7,197,856 | B2 | * | 4/2007 | Coles | 52/638 |
| 7,568,315 | B2 | * | 8/2009 | Norwood | 52/118 |
| 7,574,832 | B1 | * | 8/2009 | Lieberman | 52/118 |
| 8,046,970 | B2 | * | 11/2011 | Diniz et al. | 52/632 |

* cited by examiner

*Primary Examiner* — Brian Glessner
*Assistant Examiner* — James Buckle, Jr.
(74) *Attorney, Agent, or Firm* — Mark Swanson; David Mixon; Bradley Arant Boult Cummings

(57) ABSTRACT

An extendible mast includes at least three columns having a plurality of column sections that telescopically nest one inside another. A base plate is connected to each column, and each of a plurality of brackets is also connected to each column. The plurality of brackets are positioned along the length of the mast when extended.

16 Claims, 6 Drawing Sheets

TELESCOPING MAST

This application claims priority to U.S. Provisional Patent Application No. 61/079,329, which was filed on Jul. 9, 2008.

BACKGROUND OF THE INVENTION a. Field of the Invention

The current invention relates to extendable masts.

b. Background Art

Many devices are more useful when positioned above ground level. An antenna can transmit and/or receive signals over increased distances by elevating the antenna. Cameras or other surveillance equipment can have a wider field of view and a better vantage point if they are elevated. Lighting can cover a larger area is suspended above ground level. It is desirable for many devices to position the device above ground level. In some cases, the higher the position the better.

One technique used to raise devices is an extendible mast. A device can be mounted to the top of an extendible mast, and then raised above ground level as the mast is extended. This provides an essentially vertical mast extended from a base on the ground. In some instances, the device can be manipulated while extended. For example, a camera can be moved in different directions by rotating the mast or by providing motors with power and controls.

Holding an object at a large distance from a support can be difficult. A long mast can catch the wind, or it can begin to tip in one direction of another. This produces a force that urges the mast to fall over towards the ground. Supporting the base of the mast as a force urges the mast to tip can also cause a mast to bend and even buckle in some cases. A mast serves as a large lever aim, with the fulcrum being the base of the mast as it is supported on the ground. The longer the mast, the more force a given weight at the end of the mast produces to tip and/or bend the mast.

A mast will often be supported by guy lines to counter the effect of the long lever arm. The guy lines provide extra strength and stability. Guy lines will be connected to one or more points along the mast, and these lines will be secured to the ground at a set distance from the base of the mast. Three or more guy lines are usually attached about a single position on a mast, and the opposite ends of the guy lines are secured to the ground at a significant distance from the base of the mast. There can be one or more guy line attachment points along the length of a mast, and the taller the mast the greater the need for guy lines.

Connecting guy lines to a mast can be a time consuming and difficult task. The lines must be connected to the mast, and then taken to a guy line base position removed from the mast base. Often, the guy lines are taken to the guy line base position simultaneously so one line will not serve to pull the mast over as the guy line is extended. This requires several people working in concert to establish a mast with guy lines. It also requires a large footprint, because there are generally at least three guy line base positions extending symmetrically away from the mast base for a considerable distance.

There are many times when a temporary mast is desired. For example, extendable antennas mounted to television news crews allow the news crew to report and transmit the signal from greater distances. Military posts are often transient in nature, and reducing the time to set up and take down an extendible mast is desirable. There are many other examples of temporary needs for a mast. Keeping the footprint of a mast small is also desirable. It can also be advantageous to provide a mast which can be easily disassembled to facilitate packing and transportation.

BRIEF SUMMARY OF THE INVENTION

The current invention is a mast with at least three columns. Each column has a plurality of column sections telescopically nested one inside another, and the columns are connected to a base plate. A plurality of brackets connects the columns along the length of the column when extended.

DETAILED DESCRIPTION

An extendable telescoping mast has been developed. The present invention is a telescoping mast that may be used to mount an antenna, camera, light, loudspeaker, elevated sensors, surveillance equipment, or any other suitable device. The present invention is also portable as well as easy to install.

Columns

Figure 1:
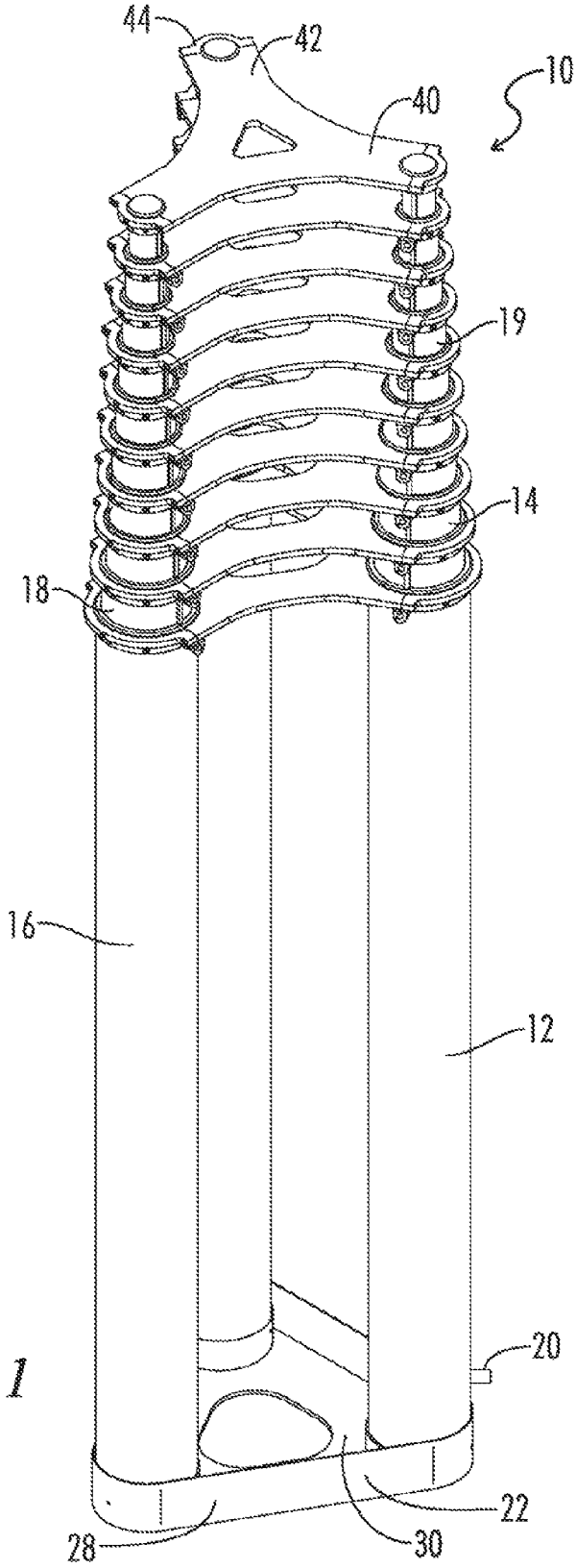
FIG. 1 shows a perspective view of a collapsed telescoping mast in accordance with one embodiment of the present invention.
Figure 2:
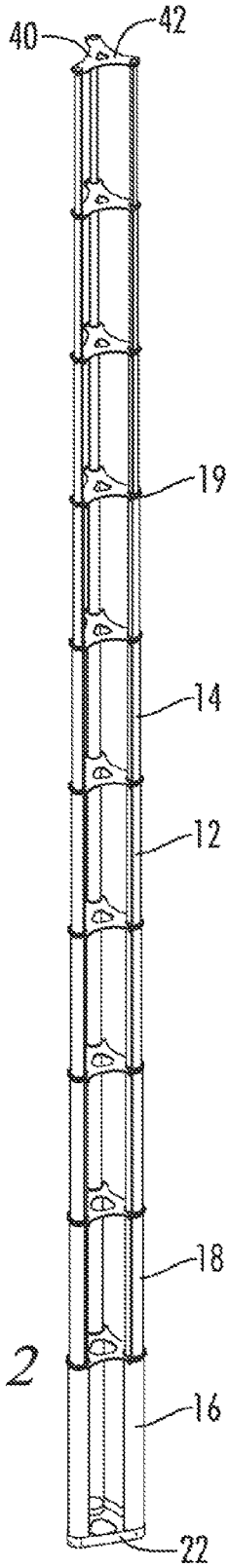
FIG. 2 shows a perspective view of an extended telescoping mast in accordance with one embodiment of the present invention.

A telescoping mast 10 includes at least three columns 12, as seen in FIGS. 1 and 2. There can be three, four, five, or more columns 12, and the configuration of the columns 12 in the mast 10 can vary. Each column 12 includes a plurality of column sections 14 telescopically nested one inside another. The column section 14 with the largest circumference is generally positioned on the bottom of the column 12, although it is possible in some embodiments to operate the mast 10 with the column section 14 with the largest circumference at the top. In either embodiment, the column sections 14 are arranged sequentially based on the circumference of the column 12.

The column section 14 with the largest circumference is referred to as the largest circumference section 16, and the column section 14 with the second largest circumference is referred to as the second largest circumference section 18. The column section 14 with the third largest circumference (if there are at least three column sections) is referred to as the third largest circumference section, and so on.

At least most of the second largest circumference section 18 fits within the largest circumference section 16 in the collapsed position. A column section top portion 19 can remain extended from the next larger circumference column section 14 when in the collapsed position. When in the extended position, most of the second largest circumference section 18 extends from the largest circumference section 16, with only a small portion of the second largest circumference section 18 still within the largest circumference section 16. This process can be repeated for each pair of adjoining column sections 14. This nesting of smaller column sections 14 within larger column sections 14 in the collapsed position, and the extension of the smaller column sections 14 from the larger column sections 14 in the extended position is the telescopic action of the columns 12.

The column 12 itself can be constructed of a wide variety of materials. The column 12 can be one of many different metals, such as aluminum or various grades of steel. The column 12 can also be polymeric, a composite, other materials, or a combination of materials. The intended service of the mast 10 may impact the material of construction of the columns 12. Factors which may be considered in selecting a material for the columns 12 include strength, weight, appearance, and other factors such as the coefficient of thermal expansion.

The column 12 telescopically extends, and several different techniques can be used to extend and collapse the column 12. In one embodiment, the column 12 is extended pneumatically by introducing pressurized air into a column interior. Such a pneumatic column 12 can have seals between the different column sections 14 to reduce or eliminate air leaks. The column 12 can include one or more nozzles 20 penetrating the shell of the column 12 to the column interior. The nozzle 20 is used to introduce pressurized air into the column interior, where the pressurized air expands and thereby extends the column 12. A nozzle 20 can also be used to allow air to escape as the column 12 is collapsed.

A hydraulically operated column 12 can include hydraulic cylinders on the column exterior, or hydraulic fluid can be introduced to the column interior similar to the air described for the pneumatically operated column 12. Another embodiment can include a threaded or helical system used for raising and lowering the column 12. An alternate embodiment includes a manually operated column 12. Many other techniques can be used for raising or lowering a column 12.

In may be desirable to lock a column 12 in the extended position. There are many possible techniques for locking a column 12 as well. For example, a simple set screw could be used, or a locking ring could be turned such that two column sections 14 were locked in position. A wedge could be used, or a locking pin could be set in place manually, remotely, or automatically. If a lock were used, the pressure in a pneumatically or hydraulically operated column 12 could be relaxed or disconnected without the column 12 collapsing. The lock could also serve as a safety feature to prevent unplanned collapsing or even unplanned extension of a column 12.

The column 12 used can have a wide variety of shapes. The column 12 can have a round cross section, a square cross section, an oblong cross section, a triangular cross section, or many other shapes as long as the various column sections 14 can telescopically collapse and extend. The column 12 may even have helical grooves for operation.

The column 12 can also include a cable, wire, or other mechanism either in the column interior or exterior to the column 12. A wire can provide electrical power from one end of the column 12 to the other, as well as providing control signals, communications, or other information. A cable can be used as a control mechanism to transfer a pulling force from one end of the column 12 to the other. The column 12 can serve as a conduit as well as a support for any of a wide variety of items.

Base Plate

Figure 3:
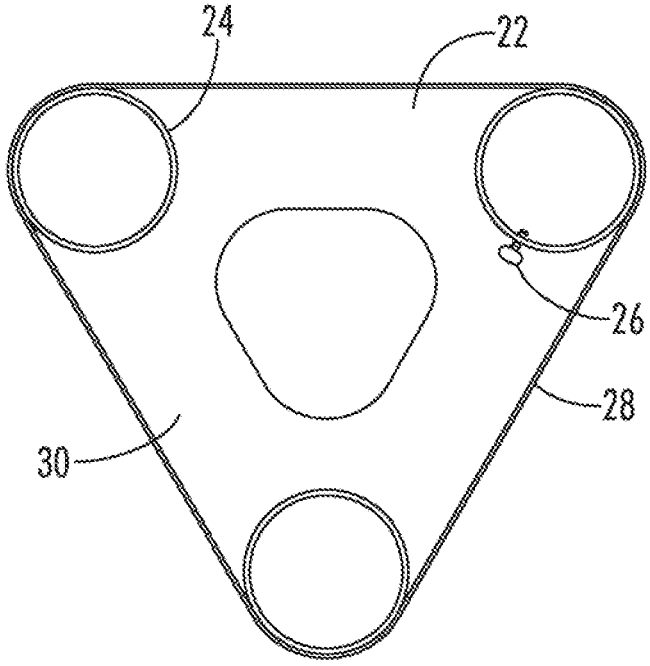
FIG. 3 shows a top view of a base plate in accordance with one embodiment of the present invention.
Figure 4:
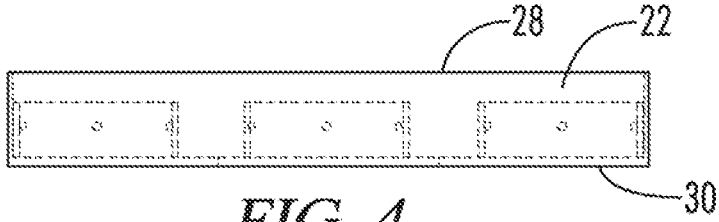
FIG. 4 shows a side view of a base plate in accordance with one embodiment of the present invention.
Figure 5:
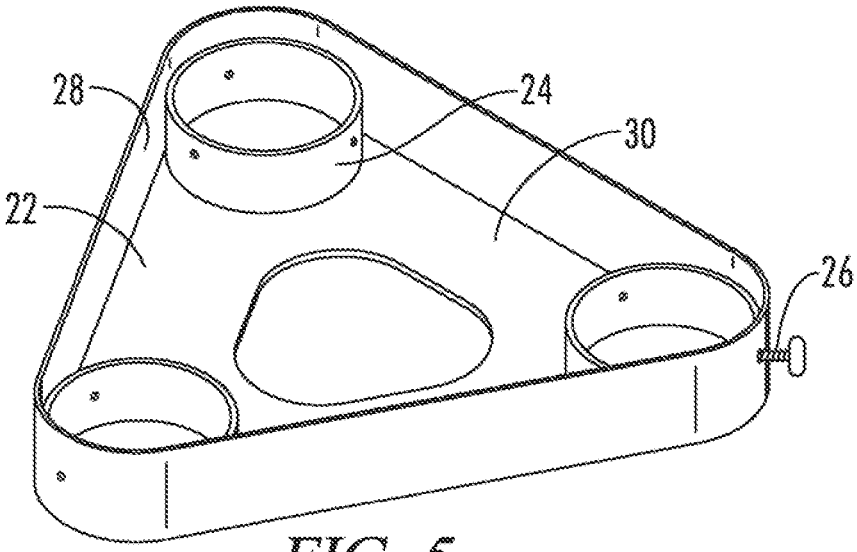
FIG. 5 shows a top perspective view of a base plate in accordance with one embodiment of the present invention.
Figure 6:
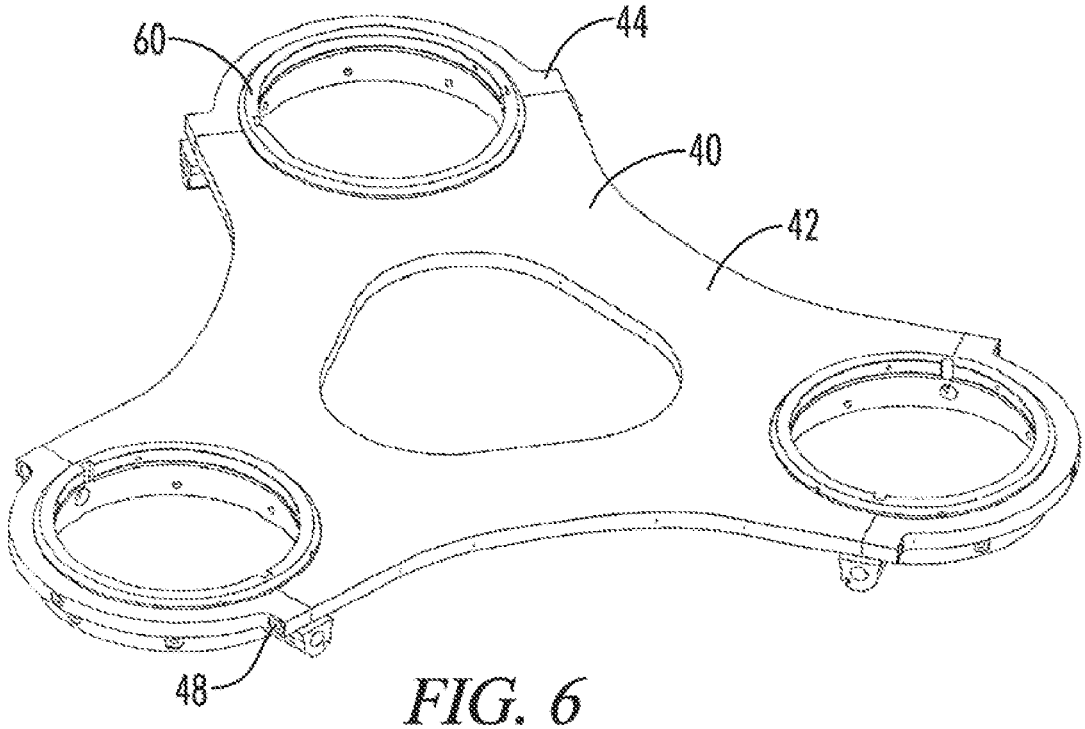
FIG. 6 shows a perspective view of a bracket in accordance with one embodiment of the present invention.
Figure 7:
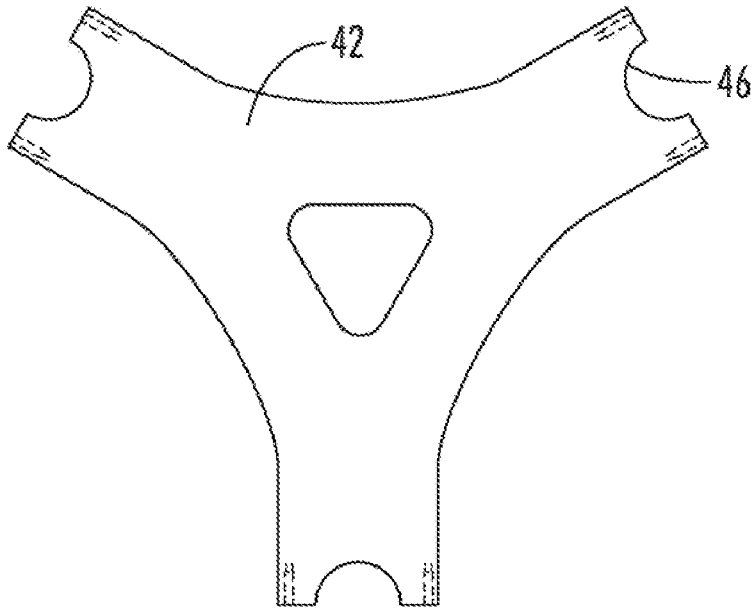
FIG. 7 shows a top view of a central section of the bracket in accordance with one embodiment of the present invention.
Figure 8:
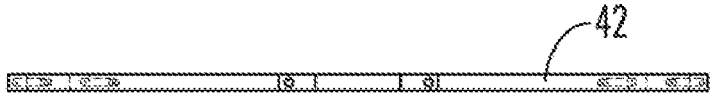
FIG. 8 shows a side view of a central section of the bracket in accordance with one embodiment of the present invention.
Figure 9:
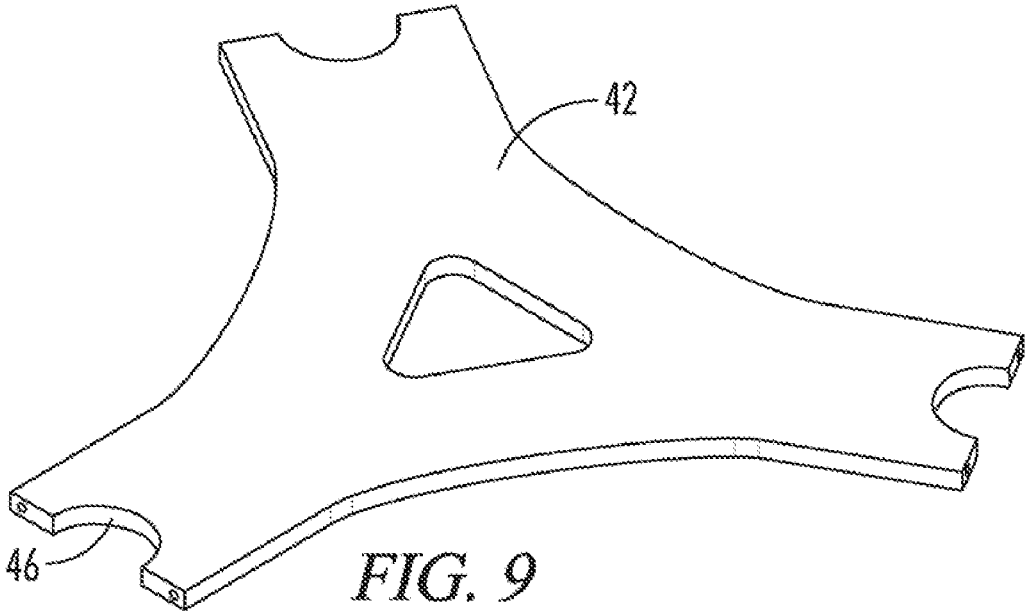
FIG. 9 shows a top perspective view of a central section of the bracket in accordance with one embodiment of the present invention.
Figure 10:
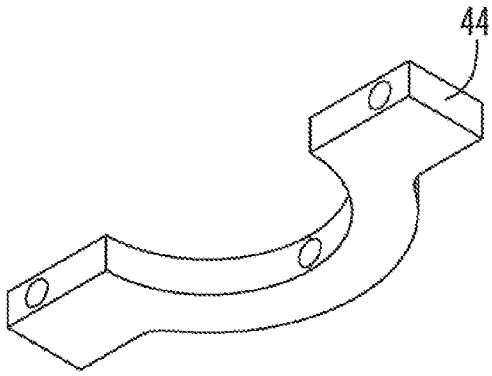
FIG. 10 shows a perspective view of the exterior clamp of the bracket in accordance with one embodiment of the present invention.
Figure 12:
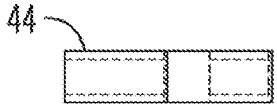
FIG. 12 shows a side view of the exterior clamp of the bracket in accordance with one embodiment of the present invention.
Figure 13:
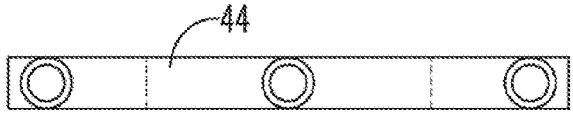
FIG. 13 shows a front view of the exterior clamp of the bracket in accordance with one embodiment of the present invention.
Figure 11:
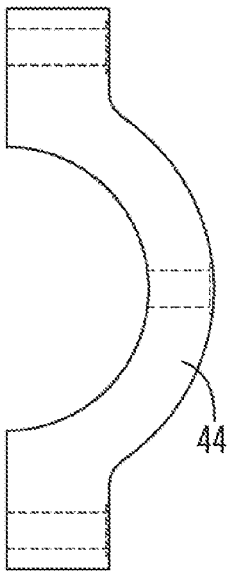
FIG. 11 shows a top view of the exterior clamp of the bracket in accordance with one embodiment of the present invention.

The columns 12 are all connected to a base plate 22, as seen in FIGS. 3, 4, and 5, with continuing reference to FIGS. 1 and 2. The base plate 22 is essentially perpendicular to the columns 12, and can be made of a wide variety of materials, similar to the columns 12. The base plate 22 can include cups 24 to secure the columns 12 to the base plate 22. The cups 24 are essentially walls extending from the base plate 22, where the walls are positioned such that the column 12 will snuggly fit within the cup 24. Therefore, if the columns 12 are round, the walls of the cup 24 will have an internal diameter which is essentially the same as the outer diameter of the lowest column section 14 in the column 12, which may be the largest circumference column section 16. The base plate 22 may also include other devices to help secure the columns 12 in the cups 24, such as a cup set screw 26.

The base plate 22 can utilize other techniques to secure the columns 12 in place. For example, the base plate 22 can include a threaded connector, such as a screw or bolt, which passes through the base plate 22 and into the lowest column section 14. Alternatively, an adhesive can be used to secure the columns 12 in place on the base plate 22. The columns 12 could be welded to the base plate 22 as well if it is not necessary to separate the columns 12 from the base plate 22 for transport. Any of a wide variety of techniques could be used to secure the columns 12 to the base plate 22.

In one embodiment, the base plate 22 is the only part of the mast 10 which is secured to keep the mast 10 from tipping over. The base plate 22 should be strong enough to withstand the torque and forces exerted by the mast 10 when the mast 10 is fully extended. This includes forces from wind and momentum from tower movements, but also forces from contact with various items such as birds, people leaning on the mast 10, etc. The base plate 22 should be able to withstand forces from other sources as well.

The base plate 22 can include a base plate outer wall 28 and a base plate floor 30 to increase strength. The base plate outer wall 28 and base plate floor 30 can be connected together and extend in different planes. Having at least two structural bodies connected together which extend in different planes can increase the strength of the entire structure, similar to the effect of the different parts of an I-beam. The base plate outer wall 28 can. extend about the perimeter of the base plate floor 30, so the base plate outer wall 28 can be in several planes along the base plate floor edges. The base plate floor 30 can also be round, so the base plate outer wall 28 can be circular as well. In one embodiment, the base plate outer wall 28 is perpendicular to the base plate floor 30 along the base plate floor perimeter. Additional structures can also be added to the base plate 22 to increase the overall strength of the base plate 22, or to facilitate securing the base plate to a stable support.

The base plate 22 can be secured to any stable support which is capable of holding the extended mast 10. The necessary stability of the support will depend on the height and weight of the mast 10, as well as the weight of any items positioned along or on top of the mast 10. In one embodiment, the base plate 22 can be secured to a vehicle, such as a truck. Alternatively, the base plate 22 can be secured to a rock, where a drill is used to bore an anchor hole for attaching the base plate 22 to the rock. In other embodiments, the base plate 22 can be set on a large metal sheet resting on soil. There are many different types of anchors and supports which can be used with the base plate 22.

In an alternate embodiment, the mast 10 can be supported by outriggers connected to the base plate 22. The outriggers extend. outward from the base plate 22, and can be either directly or indirectly connected to the base plate 22. Other embodiments include the use flexible guy lines or stiff braces which are connected to an elevated portion of the mast 10, and also secured to a support point at some distance from the base plate 22. The base plate 22 should rest on a stable support, but otherwise the various methods and techniques for supporting the mast 10 can generally be used in isolation or in almost any combination.

Bracket

The mast 10 includes a plurality of brackets 40, as seen in FIGS. 6-13, with continuing reference to FIGS. 1-5. Each bracket 40 is connected to every column 12. The brackets 40 can be connected to the column section top portion 19, so the brackets 40 do not interfere with the column 12 when the column 12 is collapsed. The brackets 40 can be connected to every column section top portion 19, or only to selected column sections 14 as desired.

Each column section 14 has a different circumference so the column 12 can telescopically expand and collapse. The brackets 40 can be specifically sized to fit the column sections 14 where the bracket 40 will be positioned. The bracket 40 should have a tight fit with the column sections 14, to better secure the mast 10. Therefore, each bracket 40 can have somewhat different dimensions, because a telescoping column 12 does not have more than one column section 14 of the same size.

The bracket 40 has a central section 42 which is connected to every column 12 in the mast 10. The central section 42 is solid. The term "solid" means the central section 42 is a one-piece component, with no joints or connected parts, so the central section 42 is continuous. The central section 42 can have holes or gaps to reduce weight, and the central section 42 can have additional components connected to it, but one solid, continuous piece is connected to every column 12 in the mast 10. Because the central section 42 is solid, the flexing, slippage, and movement which can occur at joints or unions does not occur. A solid component tends to be more ridged and stronger than a component with joints or unions, so a solid component can reduce the relative movement of the columns 12 in the mast 10 because of the increased strength and rigidity of the bracket 40. Also, one structural piece connecting all the columns 12 tends to provide a stiffness beyond that obtainable by bars or rods that extend between only two columns 12 at a time, which makes the mast 10 behave more like a single structure so each column 12 receives more support from the other columns 12.

Each central section 42 is connected to every column 12 in the mast 10. There are different techniques which can be used to connect the central section 42 to the columns 12. In one embodiment, an exterior clamp 44 is used. The central section 42 can include a plurality of indentations 46, with one indentation 46 for each column 12 in the mast 10. Part of the column section 14 fits into the indentation 46, and then the external clamp 44 goes around the rest of the column section 14. A threaded connector 48 can be used to connect the exterior clamp 44 to the central section 42. The threaded connector 48 can be a bolt or a screw. Other types of connectors can also be used, such as a latch, hook, or a catch pin.

In one embodiment, the indentation 46 fits approximately half way around the column 12, and the exterior clamp 44 fits over the other half of the column 12. This allows for easy assembly of the bracket 40 and the columns 12. The shape of the indentation 46 and the exterior clamp 44 matches the shape of the column 12 to provide a snug fit. So, a square indentation 46 and exterior clamp 44 would be used with a square column 12. In other embodiments, the indentation 46 may not be necessary. For example, a "U" shaped exterior clamp 44 could be used with a flat portion on the central section 42 for a square shaped column 12.

Threaded connectors 48 can be used on both sides of the exterior clamp 44, and there can be more than one threaded connector 48 on each side. It is also possible for the exterior clamp 44 to be connected to the central section 42 with a hinge, and only one threaded connector 48 used on the side opposite the hinge. There can also be a combination of different connectors used, as desired.

Figure 14:
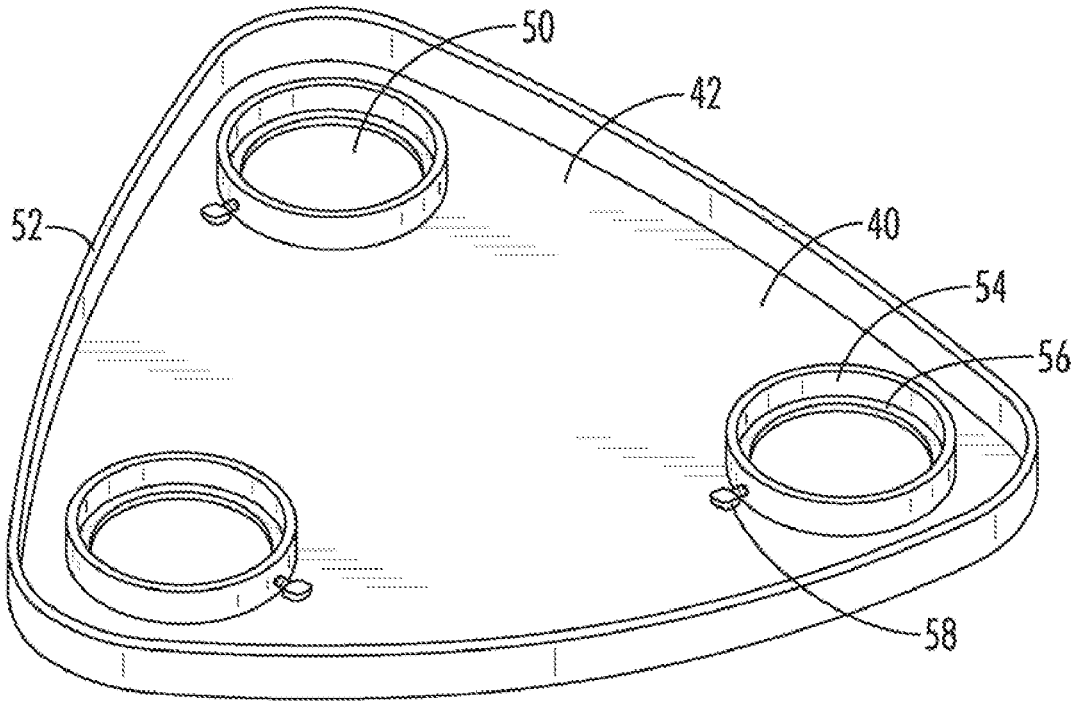
FIG. 14 shows a bottom perspective view of the bracket in accordance with a different embodiment of the present invention.

In an alternate embodiment, the central section 42 includes a plurality of holes 50, as seen in FIG. 14, with continuing reference to FIGS. 1-13. In this embodiment, the central section 42 has one hole 50 for each column 12, and the columns 12 pass through the holes 50. In one embodiment, the bracket 40 also includes a bracket outer wall 52 for added strength. The bracket wall 52 can be in a different plane than the central section 42 to increase the overall bracket strength. The holes 50 can include a hole wall 54 and a hole shelf 56.

In this embodiment, the brackets 40 are assembled with the columns 12 in a specified order. The bracket 40 is slipped over the columns 12 before the columns 12 are extended, and the holes 50 of each bracket 40 are sized for a particular column section 14. The first bracket 40 to be installed has the largest holes 50, and those holes 50 are sized to fit the largest circumference section 16. The inside dimensions of the hole wall 54 essentially match. the outside dimensions of the column section 14. The hole shelf 56 has inside dimensions which allow the bracket 40 to pass over all column sections 14 with smaller circumferences, and to rest on top of the column section 14 for which the bracket 40 is selected. The brackets 40 can be numbered or labeled to facilitate the mast assembly process.

Other techniques can also be used to secure the bracket 40 to the columns 12. For example, the central section 42 can include band clamps for each column 12. The band clamps can be tightened on the desired column sections 14, and the use of band clamps could allow for one sized bracket 40 to be used for different sized column sections 14. The column 12 and the bracket 40 could also be specifically designed to be connected, such as by providing bolt hole through the column 12 with a matching threaded bolt hole in the central section 42. A bolt could then be passed through the column 12 and threaded directly into the bracket central section 42. Many other techniques could be used to attach the columns 12 to the central sections 42.

The bracket 40 can also be secured to the columns 12 to prevent vertical movement in a variety of ways. A hole set screw 58 can be used, where the hole set screw 58 presses against the outer wall of the column 12. Alternatively, the fit of the hole wall 54 on the column 12 may be adequate to secure the bracket 40 in place, or a bolt or screw can pass through the hole wall 54 and into the column 12. Adhesive could be applied between the bracket 40 and the columns 12, or the bracket 40 may clamp about the column 12 tightly enough to prevent vertical movement. Any of a wide variety of other techniques could also be used.

A collar 60 can also be attached to the column 12, where the central section 42 attaches to the collar 60. The central section 42 is then attached to the columns 12 through the collar 60. Different collars 60 could be developed for different columns 12, so one set of brackets 12 could be used with columns 12 of more than one size. A collar 60 could also serve as an adaptor, so a column 12 having one type of cross section could be secured in a bracket 40 configured to hold a column 12 with a different type of cross section.

The brackets 40 hold the columns 12 in one position relative to each other at the points where the brackets 40 are positioned. This increases the strength of the mast 10, and allows for taller masts 10 to be used without the need for guy lines or other additional bracing techniques. When a force urges the mast 10 in the direction of a first column 12, the mast 10 will begin to bend in that direction. The force could be a gust of wind. The first column 12 is then exposed to a compression force as the mast 10 begins to bend toward it. The column 12 or columns 12 on the opposite side of the mast 10 are then exposed to an extension force as the mast 10 begins to bend away from them. The combination of the compression and extension force on different connected columns 12 increases the strength of the mast 10. Placing the brackets 40 at a plurality of intervals along the mast 10 causes the entire mast 10 to move as a singular body, and the resistance of the different columns 12 to the different types of forces exerted serves to strengthen the entire mast 10.

The solid central section 42 provides for a better bracket 40 and a stronger mast 10. The brackets 40 hold the columns 12 at a fixed distance, especially when the brackets 40 are not allowed to slide up or down along a column 12. The stiff nature of the solid bracket 40 significantly improves the strength of the overall mast 10. Even small movement of one column 12 relative to another column 12 at the bracket 40 can significantly weaken the mast 10 because of the long moment arm of the mast 10. The use of a solid central section 42 in the bracket 40 increases the overall strength of the mast 10 by reducing the movement of the columns 12 relative to each other. A stronger mast 10 can be extended to a greater height, which can be advantageous in many circumstances.

The greater the distance between the columns 12, the stronger the mast 10, as long as the brackets 40 remain stiff. A mast 10 can be made stronger by providing brackets 40 which position the columns 12 further apart, up to the point where the materials of construction fail. Positioning the columns 12 further apart also increases the footprint of the mast 10, and the size and weight of the brackets 40 used, so these factors must be balanced by the end user. Different sets of brackets 40 could be used with one set of columns 12 for different circumstances, where one set of brackets 40 positioned the columns 12 further apart than the other set of brackets 40.

Mast Benefits

A wide variety of items can be positioned atop the mast 10, or even at various points along the mast 10. The upper-most bracket 40 can be positioned at the top of the mast 10 and used as a base for an item on the top of the mast 10. The upper-most bracket 40 can include modifications for mounting and operating different items. It is also possible to include a different mounting plate on top of the mast 10, as desired. Many different items can be elevated on the mast 10, such as one or more cameras, antenna, lights, weather measurement instruments, loudspeakers, surveillance equipment, military arms, and other items as well. Some items require power, and some items are more useful if they can be controlled. For example, being able to control where a camera is facing and being able to zoom the camera in on selected objects can be desirable.

The columns 12 can be used as a conduit for wires, cables, and other items used to power and control items on the mast 10. Various wires and cables can also extend up the mast 10 exterior to the columns 12. Batteries can be used for power, and wireless controls are available, so the need for wires or cables could be eliminated in some circumstances. There are some items which do not require any control or power.

The current invention provides a very tall mast 10 which can be extended and supported without guy lines or external braces. The mast 10 can be set up in a short time by a small number of people. By avoiding the use of guy lines, the number of people required to set up and take down the mast 10 may be reduced. The columns 12, base plate 22, and brackets 40 can be disassembled and transported as separate parts. This allows for a wide variety of transport options. The mast 10 can be set up with a very small footprint, so the mast can be used in areas where available real estate is limited, such as on mountain sides or in crowded cities. It may be very difficult to use guy lines in some locations.

The brackets 40 can be removably connected to the columns 12 to facilitate the rapid deployment and subsequent packing of the mast 10. "Removable connections" can be repeatedly connected and disconnected with hand tools. Removable connections include such things as insertion of a column 12 into a cup 24 or a hole 50, bolting components together, screwing components together, clamping components together, and other connection methods which can be quickly and easily repeated. Connections which are not repeatable include welding, soldering, nailing, and using powerful adhesives.

While the invention has been described with respect to a limited number of embodiments, those skilled in the art, having the benefit of this disclosure, will appreciate that other embodiments can be devised which do not depart from the scope of the invention as disclosed here. Accordingly, the scope of the invention should be limited only by the attached claims.

We claim:

1. A telescoping mast comprising:

at least three columns, where each column has a plurality of column sections and each column section has a top portion;

a base plate removably connected to each column, where the base plate comprises cups and the columns are positioned in the cups;

a plurality of brackets, where each bracket has a central portion which is solid, the central portion comprising a plurality of bracket indentations where each column section upper portion is positioned in a different bracket indentation, the bracket further comprising an exterior clamp removably secured to the bracket central portion with at least one threaded connector such that the columns are secured in the bracket indentations by the exterior clamps so each bracket central portion is connected to each column such that the brackets hold the columns in one position relative to each other.

2. The telescoping mast of claim 1 where the columns have a round cross section.

3. The telescoping mast of claim 1 further comprising a collar connected to the columns, where the bracket is connected to the columns through the collar.

4. A telescoping mast comprising:

at least three columns, where each column comprises a plurality of column sections telescopically nested one inside another;

a base plate connected to each column; and a plurality of brackets, wherein each bracket comprises a central section connected to each column, and each central section is one solid piece and where the bracket further comprises an exterior clamp connected to the central section such that the column is positioned between the exterior clamp and the central section.

5. The telescoping mast of claim 4 where the central section further comprises a plurality of indentations with each column positioned in a different indentation.

6. The telescoping mast of claim 4 where the central section includes a plurality of holes, and where the columns are positioned within the holes.

7. The telescoping mast of claim 4 further comprising a collar positioned around the columns, where the bracket is connected to the columns through the collar.

8. The telescoping mast of claim 4 where the base plate further comprises a plurality of cups, and the columns are positioned within the cups.

9. The telescoping mast of claim 4 where the columns have a round cross section.

10. The telescoping mast of claim 4 where the columns further comprise a nozzle penetrating into a column interior.

11. A telescoping mast comprising:

at least three columns, where each column comprises a plurality of column sections telescopically nested together, and where each column section has a top portion;

a base plate connected to each column; and a plurality of brackets removably connected to the column section top portions, where each bracket is removably connected to each column, and where the bracket further comprises a central section and an exterior clamp connected together by a threaded connector, where each column is positioned between the exterior clamp and the central section.

12. The telescoping mast of claim 11 where the bracket central section is a solid, unitary piece.

13. The telescoping mast of claim 11 where the brackets include a hole.

14. The telescoping mast of claim 11 further comprising a collar connected to the columns, where the bracket is connected to the columns through the collar.

15. The telescoping mast of claim 11 where the columns have a round cross section.

16. The telescoping mast of claim 11 where the base plate further comprises a plurality of cups, and the columns are positioned within the cups.

* * * * *